US010487630B2

(12) United States Patent
Davis et al.

(10) Patent No.: US 10,487,630 B2
(45) Date of Patent: Nov. 26, 2019

(54) HIGH FLOW INJECTION SCREEN SYSTEM WITH SLEEVES

(71) Applicant: HALLIBURTON ENERGY SERVICES, INC., Houston, TX (US)

(72) Inventors: Jason Earl Davis, Rowlett, TX (US); William Mark Richards, Flower Mound, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 194 days.

(21) Appl. No.: 15/542,004

(22) PCT Filed: Mar. 6, 2015

(86) PCT No.: PCT/US2015/019120

§ 371 (c)(1),
(2) Date: Jul. 6, 2017

(87) PCT Pub. No.: WO2016/144288

PCT Pub. Date: Sep. 15, 2016

(65) Prior Publication Data

US 2018/0003010 A1 Jan. 4, 2018

(51) Int. Cl.
*E21B 43/08* (2006.01)
*E21B 33/12* (2006.01)
(Continued)

(52) U.S. Cl.
CPC ..... *E21B 43/08* (2013.01); *E21B 33/12* (2013.01); *E21B 34/06* (2013.01); *E21B 43/04* (2013.01);
(Continued)

(58) Field of Classification Search
CPC .. E21B 43/04; E21B 43/08–088; E21B 43/26; E21B 33/12; E21B 34/06; E21B 2034/007
See application file for complete search history.

(56) References Cited

U.S. PATENT DOCUMENTS

2004/0134656 A1 7/2004 Richards
2004/0149435 A1* 8/2004 Henderson ..... E21B 34/14 166/250.15

(Continued)

OTHER PUBLICATIONS

International Search Report and Written Opinion for International Application No. PCT/US2015/019120 dated Oct. 29, 2015. (10 pages).

*Primary Examiner* — David Carroll
(74) *Attorney, Agent, or Firm* — Haynes and Boone, LLP

(57) ABSTRACT

An apparatus has been described, including a tubular housing including opposing first and second end portions and defining an interior surface, an exterior surface, and an internal flow passage; an open inflow area extending radially through the tubular housing and adapted to distribute the radial flow of a fluid from the internal flow passage to the wellbore; a closure member extending within the tubular housing and adapted to cover the open inflow area; and a filter defining a plurality of gaps, the filter concentrically disposed about the exterior surface of the tubular housing and extending axially along at least the open inflow area. In an exemplary embodiment, the open inflow area includes a plurality of openings formed radially through the tubular housing and defining a tubular injection interval extending axially along the tubular housing. A system and assembly have also been described, each incorporating elements of the above described apparatus.

22 Claims, 12 Drawing Sheets

(51) Int. Cl.

| | |
|---|---|
| ***E21B 34/06*** | (2006.01) |
| ***E21B 43/04*** | (2006.01) |
| *E21B 34/00* | (2006.01) |
| *E21B 43/26* | (2006.01) |

(52) U.S. Cl.
CPC ..... *E21B 43/26* (2013.01); *E21B 2034/007* (2013.01)

(56) References Cited

U.S. PATENT DOCUMENTS

| | | | | |
|---|---|---|---|---|
| 2006/0042795 | A1 | 3/2006 | Richards | |
| 2008/0041577 | A1 | 2/2008 | Baaijens et al. | |
| 2009/0084553 | A1* | 4/2009 | Rytlewski ..... | E21B 34/06 166/305.1 |
| 2012/0080188 | A1* | 4/2012 | Richard ..... | E21B 34/06 166/278 |
| 2013/0048303 | A1 | 2/2013 | Patel et al. | |
| 2014/0034308 | A1* | 2/2014 | Holderman ..... | E21B 34/08 166/279 |

* cited by examiner

HIGH FLOW INJECTION SCREEN SYSTEM WITH SLEEVES

TECHNICAL FIELD

The present disclosure relates generally to well completion and production operations and, more specifically, to enhancing the efficiency of a single trip multi-zone completion string by utilizing a high flow injection screen system with sleeves.

BACKGROUND

In the process of completing an oil or gas well, a tubular is run downhole and may be used to communicate injection fluids from the surface into the formation, or to communicate produced hydrocarbons from the formation to the surface. This tubular may be coupled to a well-screen assembly. A particulate material is packed around the well-screen assembly to form a gravel-pack filter, i.e., a permeable mass of gravel allowing fluid to flow therethrough while blocking the flow of particulate matter from the formation into the well-screen assembly. During production, the well-screen assembly and the gravel-pack filter, in combination, control and limit debris such as gravel, sand, or other particulate matter from entering the tubular as the fluid passes through the well-screen assembly. The well-screen assembly includes a filter in the form of a wire wrapped filter, wire mesh, slotted pipe, or porous material, which has multiple entry points at which the produced or injected fluid passes through the well-screen assembly. The filter is generally cylindrical and is wrapped around a tubing joint having openings formed therein. However, in some cases, the filter may become clogged and/or may experience erosion. For example, during injection, excessive velocity of the injection fluid can cause erosion of the filter adjacent the openings, excessive build-up of formation fines in the filter due to erosion of the gravel-pack filter formed around the filter, and/or erosion or washout of proppant holding open induced fractures in the formation. Therefore, what is needed is a system, assembly, method, or apparatus that addresses one or more of these issues, and/or other issues.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
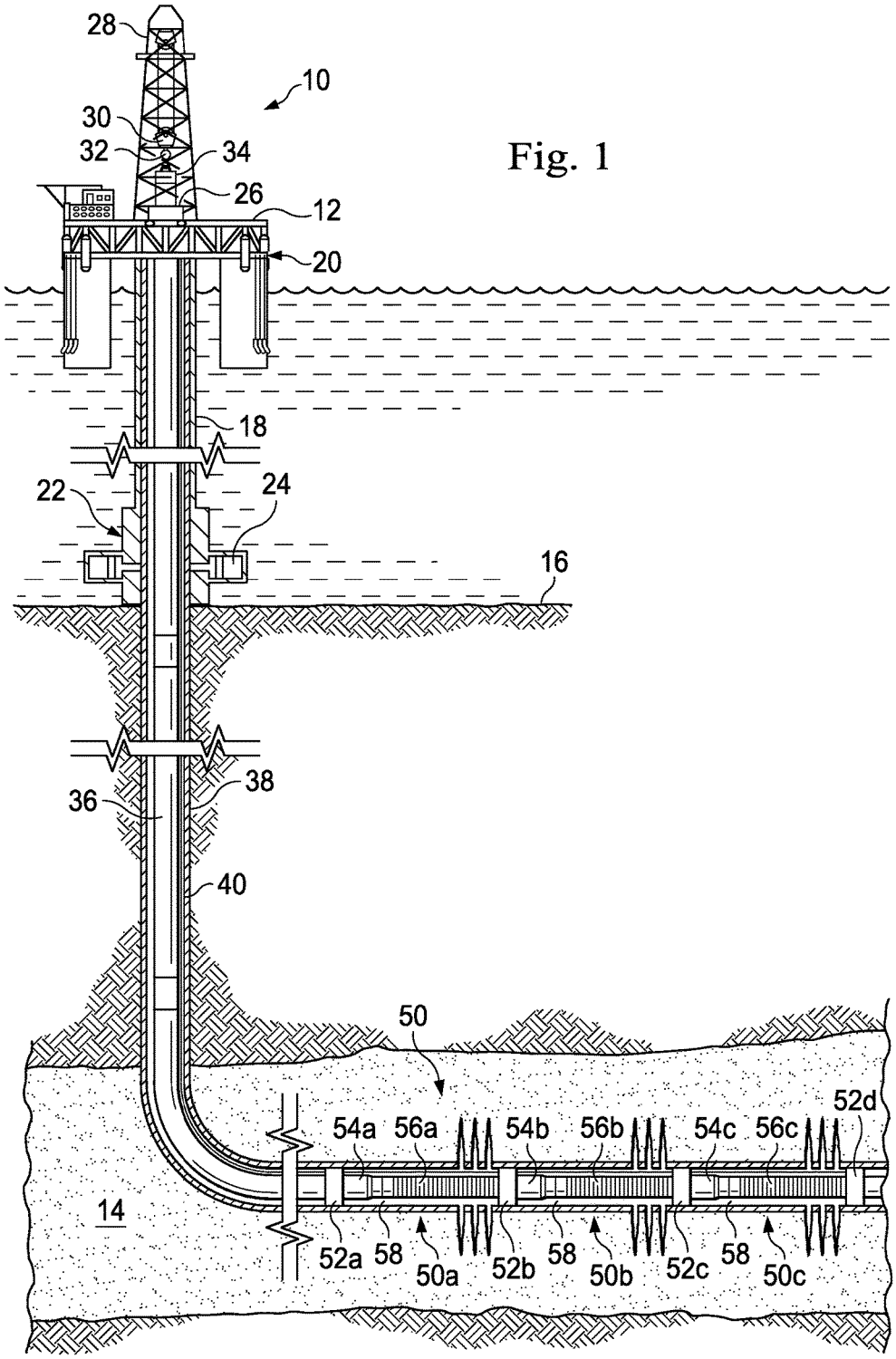
FIG. 1 is a schematic illustration of an offshore oil and gas platform operably coupled to a lower completion string disposed within a wellbore, according to an exemplary embodiment.

Illustrative embodiments and related methods of the present disclosure are described below as they might be employed in a high flow injection screen system with sleeves. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The following disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" may encompass both an orientation of above and below. The apparatus may be otherwise oriented (rotated 90 degrees or at other orientations) and the spatially relative descriptors used herein may likewise be interpreted accordingly.

In an exemplary embodiment, as illustrated in FIG. 1, an offshore oil or gas platform is schematically illustrated and generally designated by the reference numeral 10. A semi-submersible platform 12 is positioned over a submerged oil and gas formation 14 located below a sea floor 16. A subsea conduit 18 extends from a deck 20 of the platform 12 to a subsea wellhead installation 22, which includes blowout preventers 24. The platform 12 has a hoisting apparatus 26, a derrick 28, a travel block 30, a hook 32, and a swivel 34 for raising and lowering pipe strings, such as a substantially tubular, axially extending tubing string 36. A wellbore 38 extends through the various earth strata including the formation 14 and has a casing string 40 cemented therein.

In an exemplary embodiment, disposed in a substantially horizontal portion of the wellbore 38 at the lower end of the tubing string 36 is a generally tubular lower completion string 50, which includes one or more completion sections 50*a-c* corresponding to different zones of the formation 14. The lower completion string 50 includes: at least one isolation packer 52, such as isolation packers 52*a-c*, to form an annular seal between the casing string 40 and the lower completion string 50, thereby separating the different completion sections 50*a-c* of the lower completion string 50; at least one gravel-pack assembly 54, such as gravel-pack assemblies 54*a-c*, to facilitate frac-packing or gravel-packing each zone of the formation 14; and at least one valved filter assembly 56, such as valved filter assemblies 56*a-c*, to control and limit debris such as gravel, sand, and other particulate matter from entering the lower completion string 50 and, thereafter, the tubing string 36. Each of the isolation packers 52*a-c*, respectively, the gravel-pack assemblies 54*a-c*, respectively, and the valved filter assemblies 56*a-c*, respectively, corresponds to a respective completion section 50*a-c* of the completion string 50. An annulus 58 is defined between the casing string 40 and the lower completion string 50. As noted above, each of the isolation packers 52*a-c* forms a seal between the lower completion string 50 and the casing string 40; as a result, the completion sections 50*a-c* are fluidically isolated within the annulus 58. The completion string 50 also includes a sump packer 52*d*, which forms a seal between the casing string 40 and the completion section 50*c*. Each gravel-pack assembly 54*a-c*, respectively, and each valved filter assembly 56*a-c*, respectively, is made-up on the lower completion string 50 below respective ones of the isolation packers 52*a-c*.

Although FIG. 1 depicts a horizontal wellbore, it should be understood by those skilled in the art that the apparatus according to the present disclosure is equally well suited for use in wellbores having other orientations including vertical wellbores, slanted wellbores, multilateral wellbores or the like. Accordingly, it should be understood by those skilled in the art that the use of directional terms such as "above," "below," "upper," "lower," "upward," "downward," "uphole," "downhole" and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the apparatus according to the present disclosure is equally well suited for use in onshore operations. Further, even though FIG. 1 depicts a cased hole completion, it should be understood by those skilled in the art that the apparatus according to the present disclosure is equally well suited for use in open hole completions.

As indicated above, each completion section 50*a-c* includes respective ones of the isolation packers 52*a-c*, the gravel-pack assemblies 54*a-c*, and the valved filter assemblies 56*a-c*. The completion sections 50*a-c* are identical to one another. Therefore, in connection with FIGS. 2A-2D, 3A, 3B, 4A-4D, 5A, 5B, 6A, and 6B, only one of the completion sections 50*a-c* will be described in detail below using the foregoing reference numerals, but the suffixes *a-c* will be omitted to indicate that the description below applies to any one of the completion sections 50*a-c*. Thus, as illustrated in FIGS. 2A-2D with continuing reference to FIG. 1, each completion section 50*a-c* of the lower completion string 50 includes the isolation packer 52, the gravel-pack assembly 54, and the valved filter assembly 56. In an exemplary embodiment, the isolation packer 52 is a hydraulic set packer. In several exemplary embodiments, the isolation packer 52 is another type of packer that is not a hydraulic set packer, such as, for example, a mechanical set packer, a tension set packer, a rotation set packer, an inflatable packer, another type of packer capable of sealing the annulus 58, or any combination thereof. The gravel-pack assembly 54 is generally tubular and further includes an extension 60, a gravel-pack valve 62, and an indicator collar 64. The extension 60 extends between the isolation packer 52 and the gravel-pack valve 62, thereby spacing out the gravel-pack valve 62 below the isolation packer 52. The indicator collar 64 provides a contact surface for the weight down collet of the service tool (not shown) to rest on, thereby aligning the crossover port of the service tool (not shown) with the gravel-pack valve 62. The gravel-pack valve 62 is adapted to direct the flow of a treatment fluid 66 from the crossover port of the service tool (not shown) into the annulus 58. In several exemplary embodiments, the treatment fluid 66 may include any treatment fluid used to enhance production or injection such as, for example, a gravel slurry, a proppant slurry, a slurry including another granular media, hydrocarbons, a fracturing fluid, an acid, other fluids introduced or occurring naturally within the well or the formation 14, or any combination thereof.

As shown in FIGS. 2A-2D, the valved filter assembly 56 defines an internal flow passage 68 and is made-up to include the following generally tubular members, which overall extend from an upper end portion 56*a* to a lower end portion 56*b* of the valved filter assembly 56: an injection sleeve subassembly 70, a frac sleeve subassembly 72, and, in some embodiments, a flush joint pipe 74. The frac sleeve subassembly 72 is made-up proximate the lower end portion 56*b* of the valved filter assembly 56. One or more injection sleeve subassemblies 70 are made-up at intervals in the valved filter assembly 56 above the frac sleeve subassembly 72. In an exemplary embodiment, one or more injection sleeve subassemblies 70 are made-up in series above the frac sleeve subassembly 72. In several exemplary embodiments, one or more of the flush joint pipes 74 are made-up at least: between the frac sleeve subassembly 72 and the lowermost injection sleeve subassembly 70; between one or more respective pairs of the injection sleeve subassemblies 70; and above the uppermost injection sleeve subassembly 70. Alternatively, in several exemplary embodiments, the flush joint pipes 74 are omitted and the valved filter assembly 56 is made-up by connecting the injection sleeve subassemblies 70 directly to one another and by connecting the frac sleeve subassembly 72 to the lowermost injection sleeve subassembly 70. A screen 76 is disposed along the outer surface of the made-up valved filter assembly 56. In several exemplary embodiments, the screen 76 is disposed along the outer surface of the entire valved filter assembly 56 from the lower end portion 56*b* to the upper end portion 56*a*. Alternatively, in several exemplary embodiments, the screen 76 includes a plurality of axially-spaced screen segments, with respective ones of the screen segments being disposed about the outer surface of a portion of the valved filter assembly 56, including at least the injection sleeve subassemblies 70 and the frac sleeve subassembly 72. In yet another exemplary embodiment, the screen 76 includes a plurality of axially-spaced screen segments, with respective ones of the screen segments being disposed about the outer surface of a portion of the valved filter assembly 56, including at least the injection sleeve subassemblies 70.

In an exemplary embodiment, the screen 76 is a filter formed of wire 76*a* and disposed along the outer surface of the made-up valved filter assembly 56. In an exemplary embodiment, the wire 76*a* is wound or wrapped onto the valved filter assembly 56 to form the screen 76. In other embodiments, the filter is tubular and is made from a filter medium such as wire wraps, mesh, sintered material, pre-packed granular material, and other materials known in the industry. The filter medium can be selected for the particular well environment to effectively filter out solids from the reservoir. In several exemplary embodiments, the screen 76 is an elongated tubular member disposed on the valved filter assembly 56 so as to define an annular flow passage 78 between the screen 76 and the valved filter assembly 56. The annular flow passage 78 may be defined between one or more adjacent screens laid over one another or by the screen 76 itself. The annular flow passage 78 is commonly called a drainage layer, and may be formed using standoff supports (not shown) arranged in parallel, and circumferentially spaced around the exterior surface of the valved filter assembly 56 to support the screen 76 in a radially spaced apart arrangement from the valved filter assembly 56. The annular flow passage 78 may also be formed using corrugated metal, perforated tubes, or bent shapes to support the screen 76. In any event, the annular flow passage 78 directs the flow of the treatment fluid 66 towards the internal flow passage 68 of the lower completion string 50 during treatment operations. In several exemplary embodiments, during injection operations, gaps between the wires 76*a* form openings, or gaps 76*b*, through which an injection fluid 67 passes from the annular flow passage 78 into the annulus 58. In several exemplary embodiments, the injection fluid 67 may include any injection fluid such as, for example, fresh water, seawater, or produced brine. The water, which may have been produced from an adjoining well, is treated to remove organic materials and oxygen before it is pumped into the injection well. In several exemplary embodiments, one or more interface rings 80 are disposed about the exterior surface of the valved filter assembly 56 to secure the screen 76 to the valved filter assembly 56. In one or more embodiments, the interface rings 80 may be secured using a shrink fit connector to secure the screen 76 to the valved filter assembly 56. However, the screen 76 may be attached to the valved filter assembly 56 in a variety of ways such as, for example, using a friction fit connector, a threaded connection, a nut and bolt, a weld, another mechanical connection, or any combination thereof. In those embodiments where the screen 76 includes a plurality of axially-spaced screen segments, an alternate annular flow path (not shown) is formed along those portions of the valved filter assembly 56 that do not have a respective one of the screen segments disposed therealong. The alternate annular flow path permits communication of the treatment fluid 66 along the outer surface of the valved filter assembly 56 between adjacent annular flow paths 78 defined by respective ones of the screen segments.

Figure 2A:
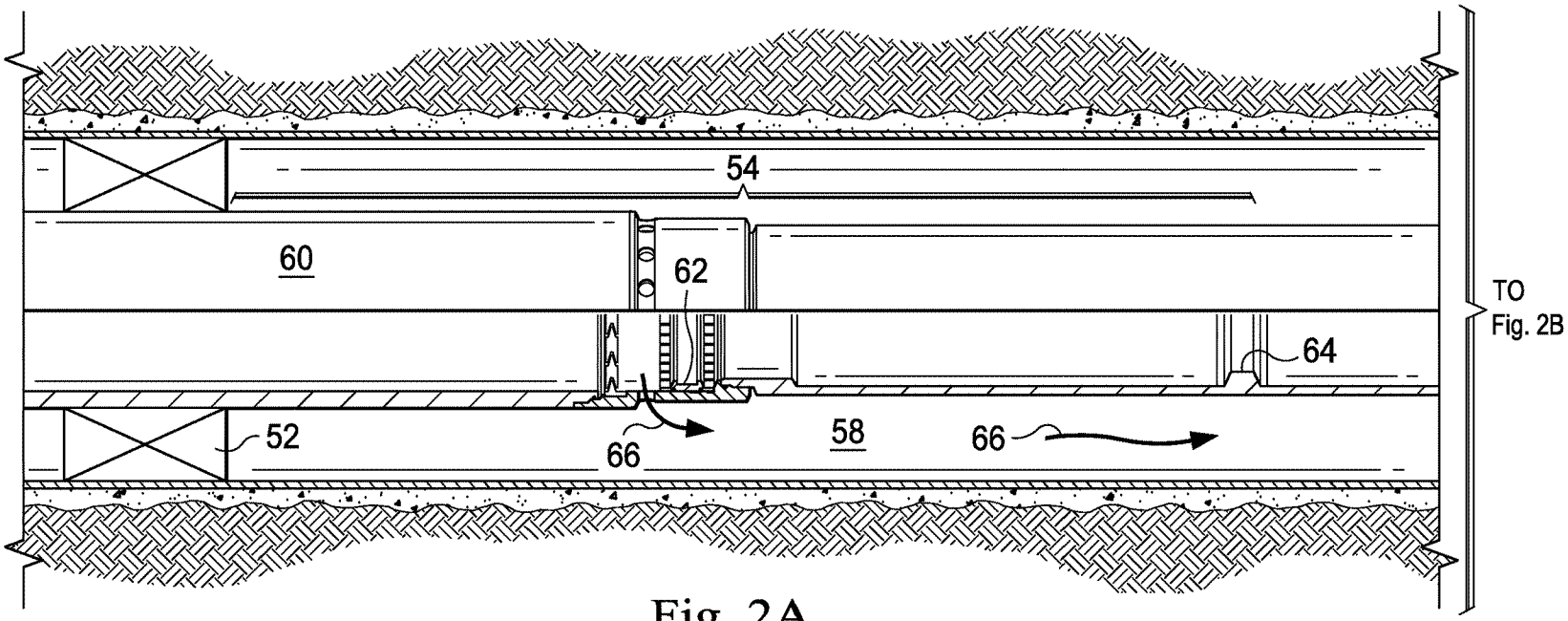
FIGS. 2A-2D illustrate a side partial-sectional view of a section of the lower completion string of FIG. 1 configured for completion operations and including an injection sleeve subassembly, according to an exemplary embodiment.
Figure 2B:
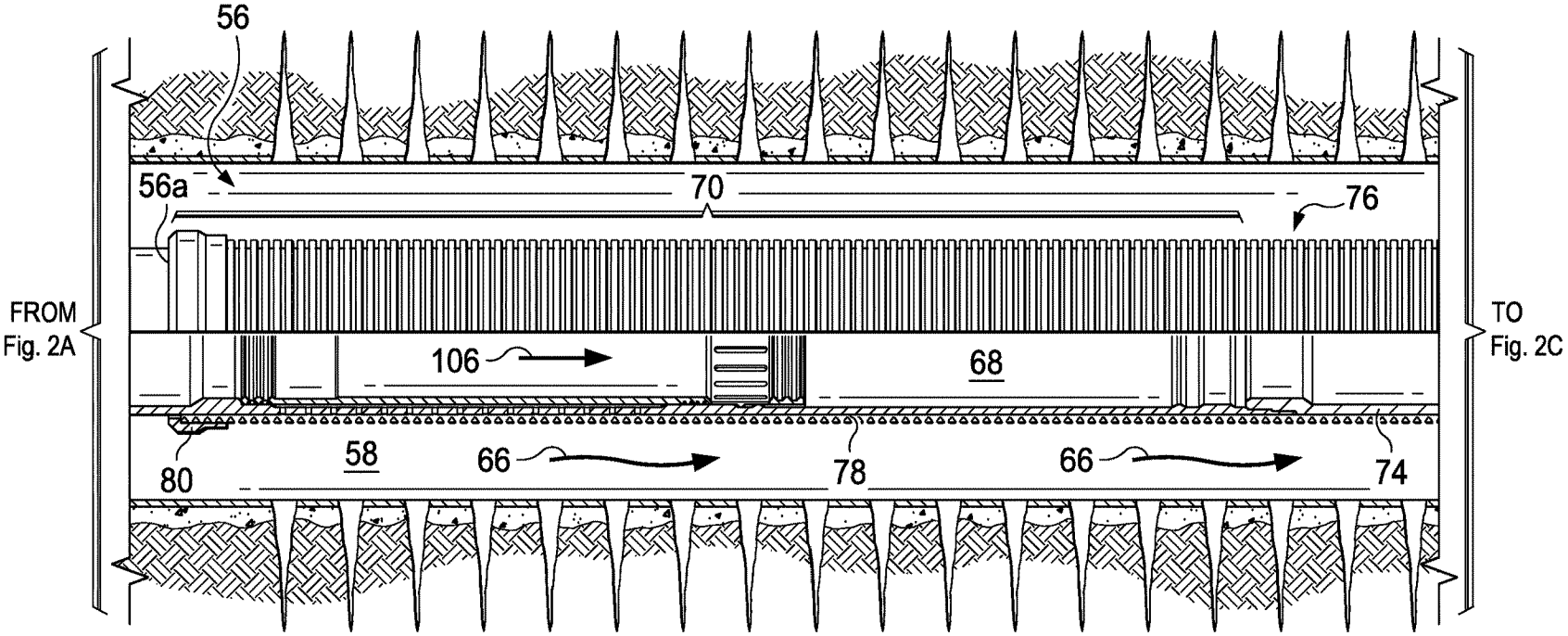
Figure 2C:
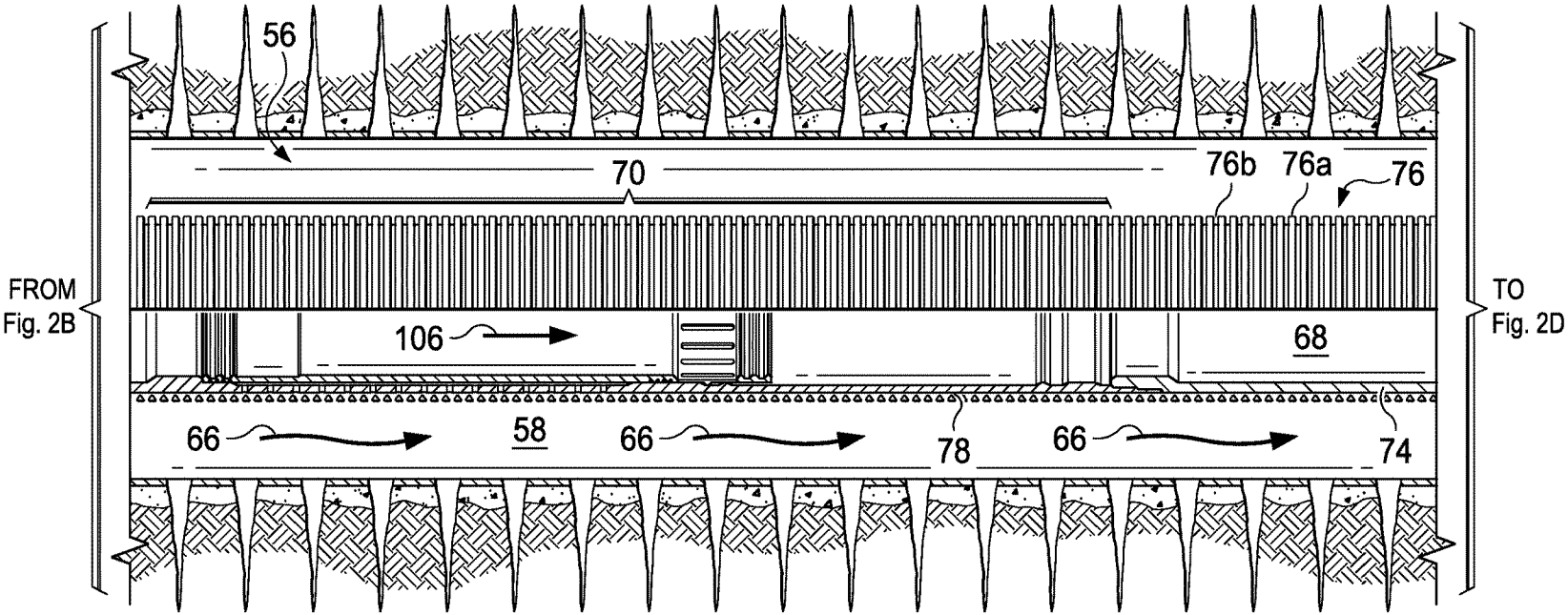
Figure 2D:
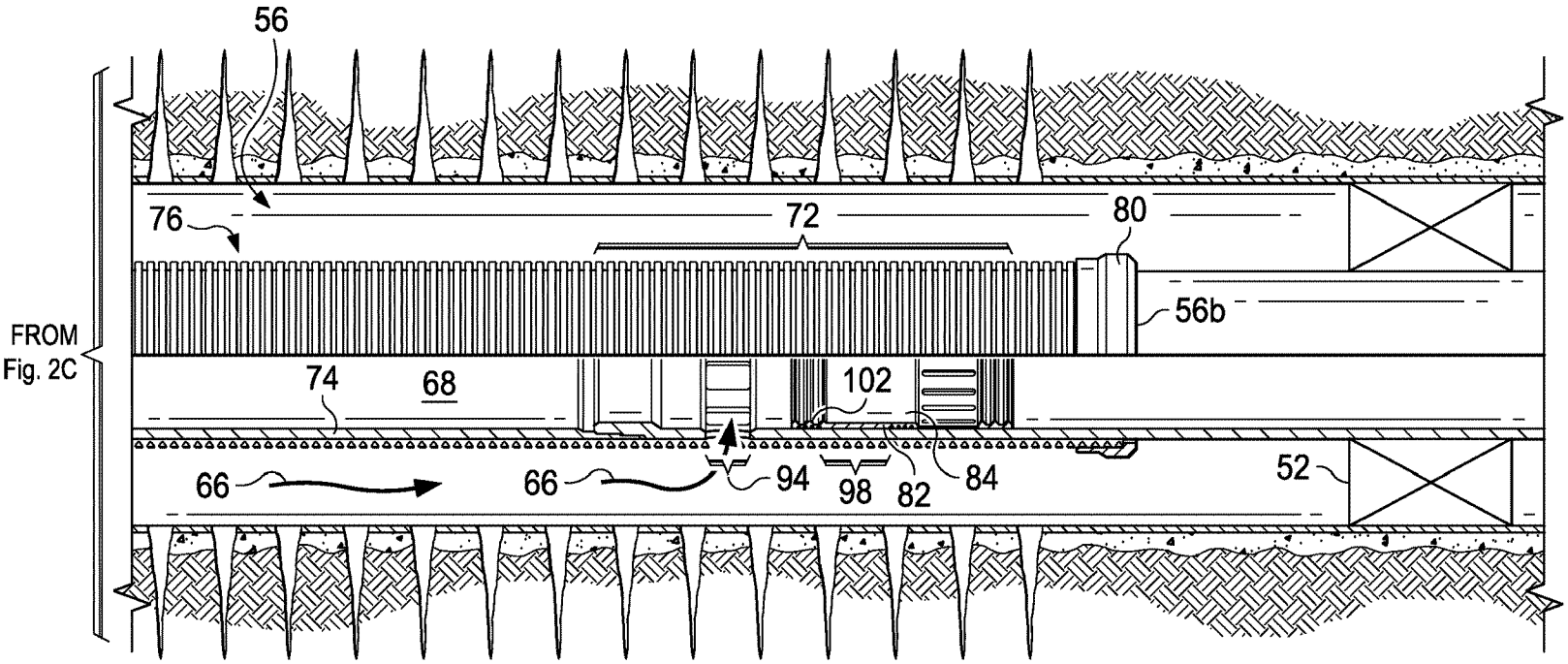
Figure 3A:
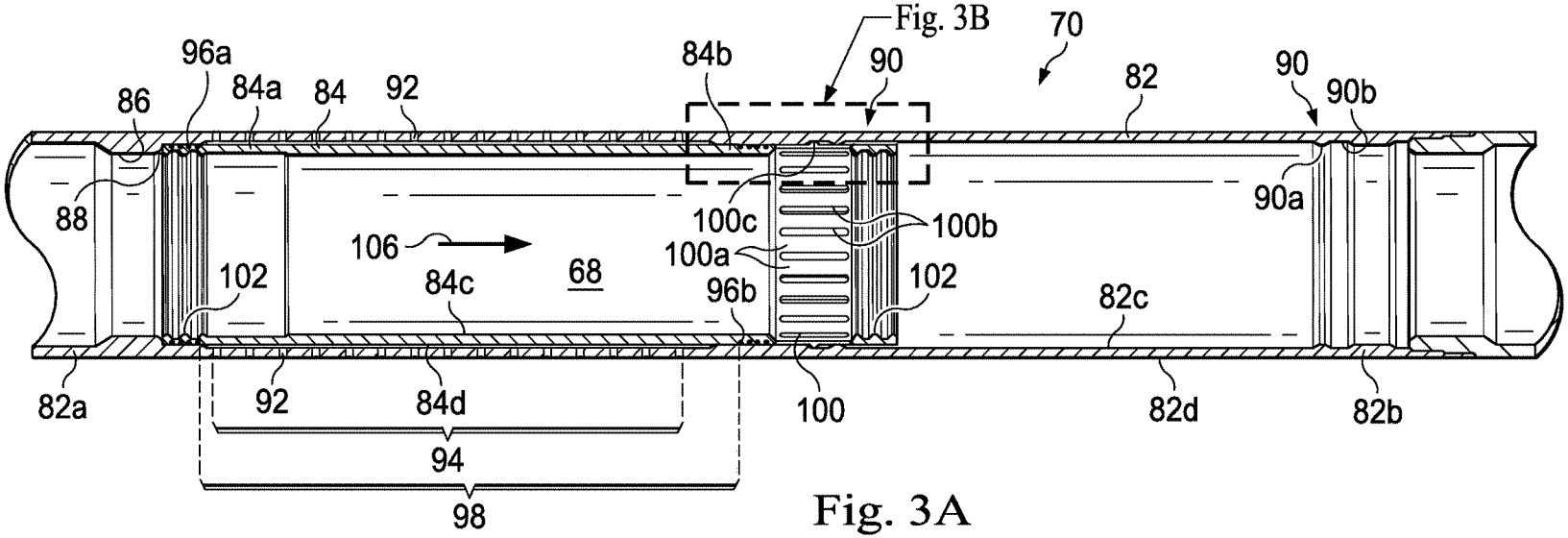
FIG. 3A is a side cross-sectional view of the injection sleeve subassembly of FIGS. 2A-2D in a closed configuration, according to an exemplary embodiment.
Figure 3B:
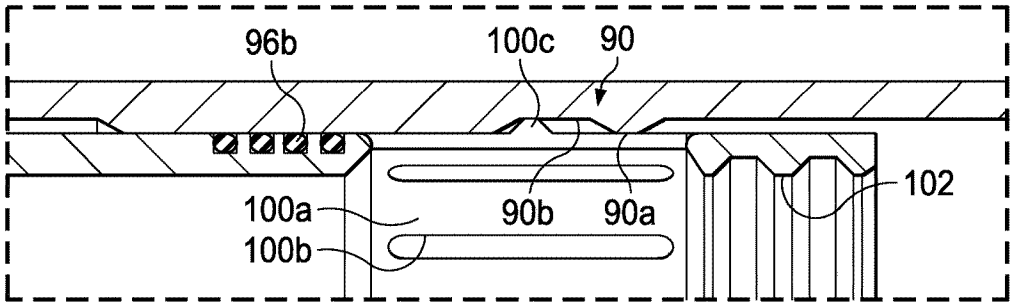
FIG. 3B is an enlarged view of a portion FIG. 3A, according to an exemplary embodiment.

In an exemplary embodiment, as illustrated in FIGS. 3A and 3B with continuing reference to FIGS. 2A-2D, each injection sleeve subassembly 70 defines a portion of the internal flow passage 68 of the lower completion string 50. The injection sleeve subassembly 70 includes a generally tubular housing 82 having an upper end portion 82*a*, a lower end portion 82*b*, an inner surface 82*c*, and an outer surface 82*d*, and a closure member such as, for example, a generally tubular sleeve 84, having an upper end portion 84*a*, a lower end portion 84*b*, an inner surface 84*c*, and an outer surface 84*d*. The internal diameter of the housing 82 is restricted near the upper end portion 82*a* by a circumferentially extending ridge 86. The ridge 86 defines an internal shoulder 88 on the inner surface 82*c* of the housing 82. A plurality of axially-spaced holds 90 are concentrically disposed on the inner surface 82*c* below the internal shoulder 88. Two (2) axially-spaced holds 90 are shown in FIG. 3A. As most clearly shown in FIG. 3B, in an exemplary embodiment, each of the holds 90 includes a ridge 90*a* and a groove 90*b*. Both the ridge 90*a* and the groove 90*b* extend circumferentially around a diameter of the inner surface 82*c* of the housing 82. The groove 90*b* is adjacent the ridge 90*a*. The distal end of the ridge 90*a* extends radially inward from the inner surface 82*c* of the housing 82.

As shown in FIG. 3A, an open inflow area, in the form of a plurality of openings 92, extends radially through the housing 82, thereby defining an axially-extending injection interval 94 below the internal shoulder 88. In an exemplary embodiment, the holds 90 are positioned below the injection interval 94. In another exemplary embodiment, the holds 90 are positioned above the injection interval 94. In yet another exemplary embodiment, one or more of the holds 90 are positioned along the injection interval 94. A dynamic seal 96*a* such as, for example, an O-ring, is disposed around the outer surface 84*d* of the sleeve 84 between the upper end portion 84*a* and the housing 82. Similarly, a dynamic seal 96*b* is disposed around the outer surface 84*d* of the sleeve 84 between the lower end portion 84*b* and the housing 82. A sealing interval 98 is defined on the sleeve 84 between the dynamic seals 96*a*, 96*b*. The length of the sealing interval 98 defined on the sleeve 84 is greater than the length of the injection interval 94 defined on the housing 82. The sleeve 84 is disposed within the housing 82 below the internal shoulder 88. The dynamic seals 96*a*, 96*b* are engaged with the inner surface 82*c* of the housing 82, thereby preventing, or at least reducing, any annular flow of the treatment fluid 66 or the injection fluid 67 at the interfaces between the dynamic seals 96*a* or 96*b*, the housing 82, and the sleeve 84.

As shown in FIGS. 3A and 3B, the sleeve 84 includes a latch 100 which is selectively retainable, in turn, by each of the plurality of holds 90 in the housing 82. In several exemplary embodiments, the latch 100 is integrally formed with the sleeve 84. The latch 100 includes a plurality of circumferentially spaced, longitudinally extending flexible spokes 100*a*. A plurality of circumferentially spaced, longitudinally extending slots 100*b* are defined between the spokes 100*a*, and are interposed with the spokes 100*a*. Each spoke 100*a* includes a centrally located catch 100*c* extending radially outward therefrom. In an exemplary embodiment, as shown in FIGS. 3A and 3B, the latch 100 is formed below the dynamic seal 96*b*. In another exemplary embodiment, the latch 100 is formed above the dynamic seal 96*a*. One or more selective shifting profiles 102 are formed on the inner surface 84*c* of the sleeve 84 and are configured to be engaged by a shifting tool (not shown). Two (2) axially-spaced apart selective shifting profiles 102 are shown in FIG. 3A, one being formed below and adjacent the latch 100 at the end portion 84*b* and the other being formed above the latch 100 at the end portion 84*a*. Engagement between the shifting tool (not shown) and the selective shifting profiles 102 results from a set of shifting keys (not shown) complementarily engaging the selective shifting profiles 102. The shifting keys on the shifting tool are configured to bypass any other profiles formed within the lower completion string 50, so as to engage only the selective shifting profiles 102.

FIGS. 4A-4D, 5A and 5B illustrate the injection sleeve subassemblies 70 in a full-open configuration, i.e., with the sealing interval 98 of the sleeve 84 displaced below the injection interval 94 of the housing 82, thereby allowing the injection fluid 67 to flow from the internal flow passage 68 to the annulus 58. In the full-open configuration, the sealing interface between the dynamic seal 96*a*, the sleeve 84, and the housing 82 is situated below the injection interval 94. In this position, the dynamic seal 96*a* is located between the dynamic seal 96*b* and the injection interval 94. Additionally, the catches 100*c* are radially pressed by the spokes 100*a* into the groove 90*b* of the lowermost hold 90. FIGS. 2A-2D, 3A and 3B illustrate the injection sleeve subassemblies 70 in a closed configuration, i.e., with the sealing interval 98 of the sleeve 84 covering the injection interval 94 of the housing 82, thereby preventing, or at least reducing, the flow of the treatment fluid 66 or the injection fluid 67 between the internal flow passage 68 and the annulus 58. In the closed configuration, the injection interval 94 is situated laterally between the dynamic seal 96*a* and the dynamic seal 96*b*. Additionally, the catches 100*c* are radially pressed by the spokes 100*a* into the groove 90*b* of the uppermost hold 90.

In several exemplary embodiments, the injection sleeve subassemblies 70 are capable of being shifted to one or more partially-open configurations, between the closed configuration and the full-open configuration. In an exemplary embodiment, the one or more partially-open configurations are achieved by using the shifting tool to displace the sleeve 84 such that the latch 100 engages a hold 90, the hold 90 being disposed on the inner surface 82*c* of the housing 82 between the uppermost hold 90 and the lowermost hold 90.

To change each injection sleeve subassembly 70 from the full-open configuration illustrated in FIGS. 4A-4D, 5A, and 5B to the closed configuration illustrated in FIGS. 2A-2D, 3A, and 3B, the shifting tool (not shown) displaces the sleeve 84 by first engaging a set of shifting keys (not shown) complementarily with the selective shifting profiles 102. The shifting tool (not shown) then displaces the sleeve 84 in a direction 104, causing the catches 100*c* of the latch 100 to contact the ridge 90*a* of the lowermost hold 90. The shifting tool (not shown) applies upward force to the sleeve 84 until the latch 100 reaches a breakaway force, at which point the spokes 100*a* flex radially inward, allowing the catches 100*c* of the latch 100 to pass over the ridge 90*a* of the lowermost hold 90. The shifting tool (not shown) continues to displace the sleeve 84 upward until the catches 90*b* pass over the ridge 90*a* of the uppermost hold 90 and are radially pressed into the adjacent groove 90*b* by the spokes 100*a*, thereby achieving the closed configuration.

To change each injection sleeve subassembly 70 from the closed configuration illustrated in FIGS. 2A-2D, 3A, and 3B to the full-open configuration illustrated in FIGS. 4A-4D, 5A, and 5B, the shifting tool (not shown) displaces the sleeve 84 by first engaging a set of shifting keys (not shown) complementarily with the selective shifting profiles 102. The shifting tool (not shown) then displaces the sleeve 84 in a direction 106, causing the catches 100*c* of the latch 100 to contact the ridge 90*a* of the uppermost hold 90. The shifting tool (not shown) applies downward force to the sleeve 84 until the latch 100 reaches a breakaway force, at which point the spokes 100*a* flex radially inward, allowing the catches 100*c* of the latch 100 to pass over the ridge 90*a* of the uppermost hold 90. The shifting tool (not shown) continues to displace the sleeve 84 downward until the catches 90*b* pass over the ridge 90*a* of the lowermost hold 90 and are radially pressed into the adjacent groove 90*b* by the spokes 100*a*, thereby achieving the full-open configuration.

Figure 4A:
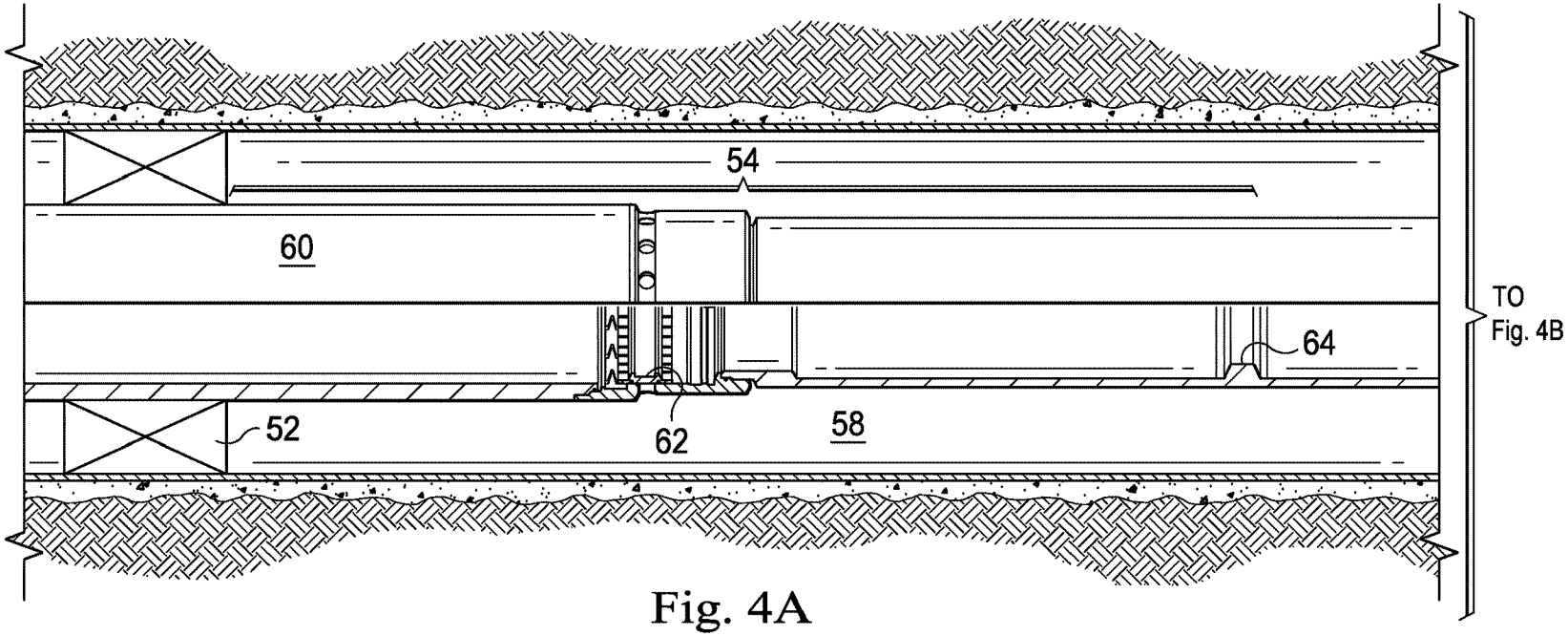
FIGS. 4A-4D illustrate a side partial-sectional view of the section of the lower completion string of FIGS. 2A-2D, the section being configured for injection operations, according to an exemplary embodiment.
Figure 4B:
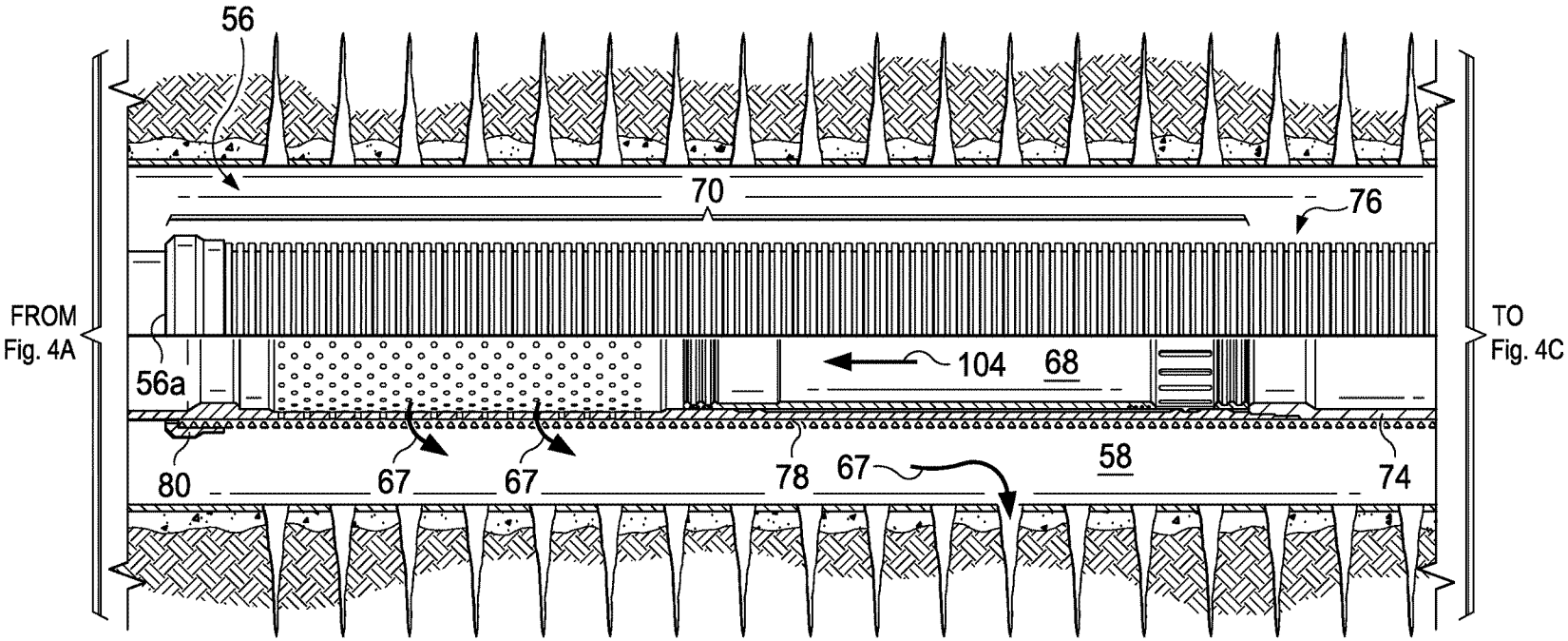
Figure 4C:
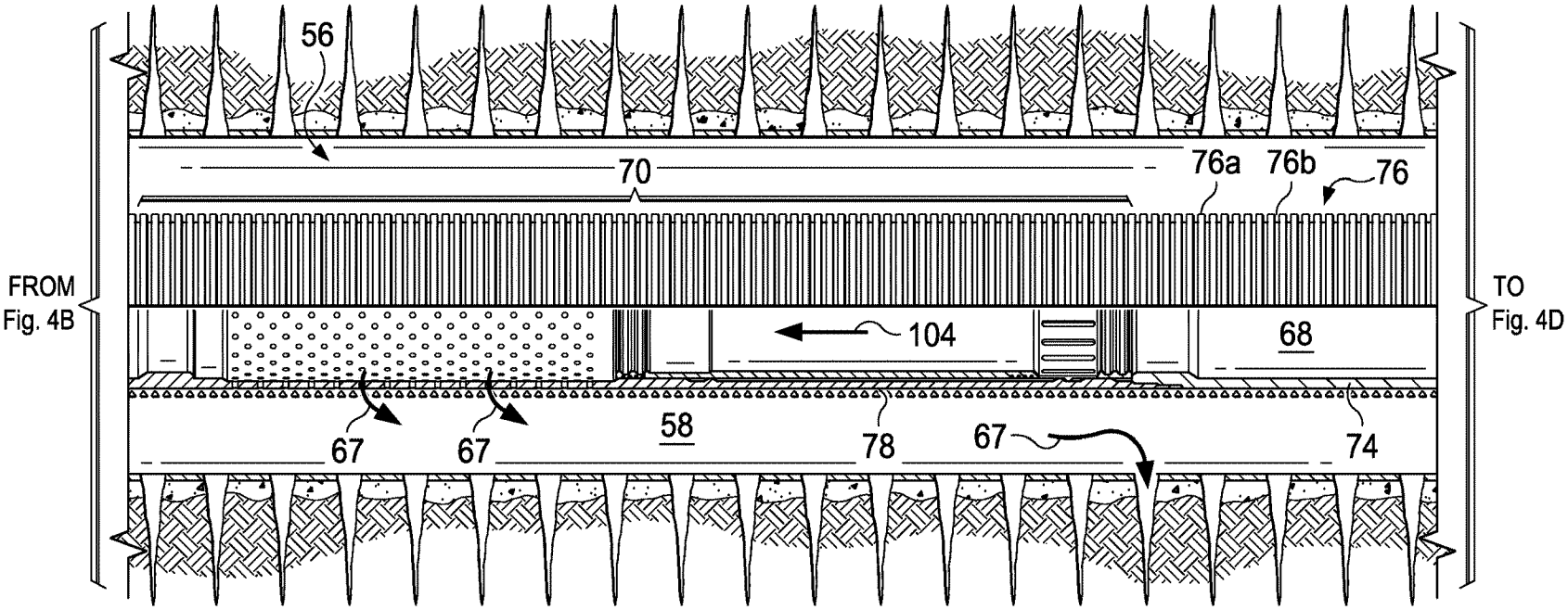
Figure 4D:
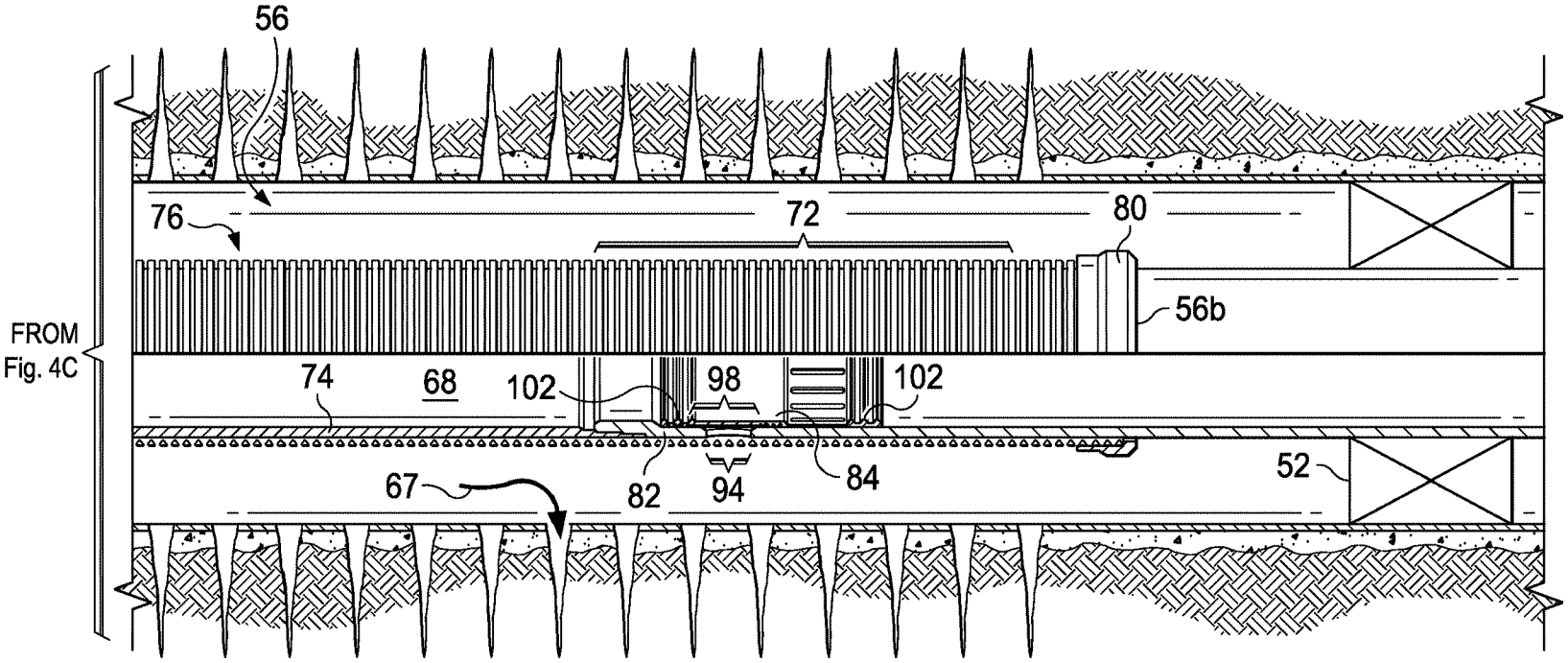
Figure 5A:
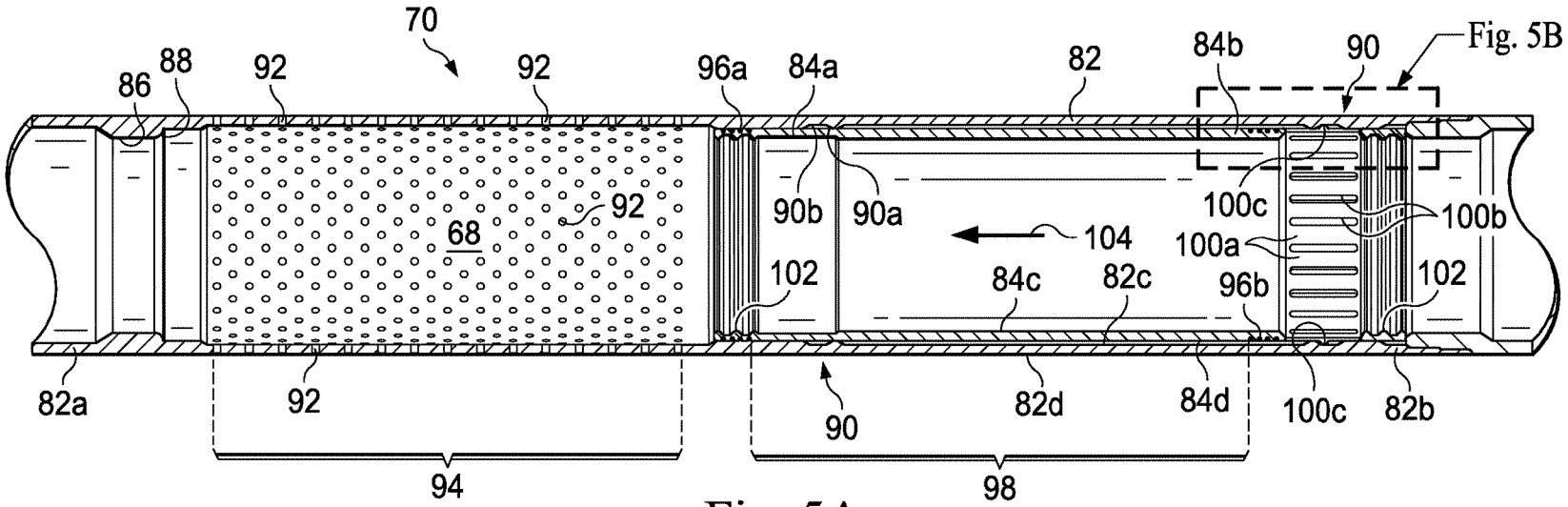
FIG. 5A is a side cross-sectional view of the injection sleeve subassembly of FIG. 3A in a full-open configuration, according to an exemplary embodiment.
Figure 5B:
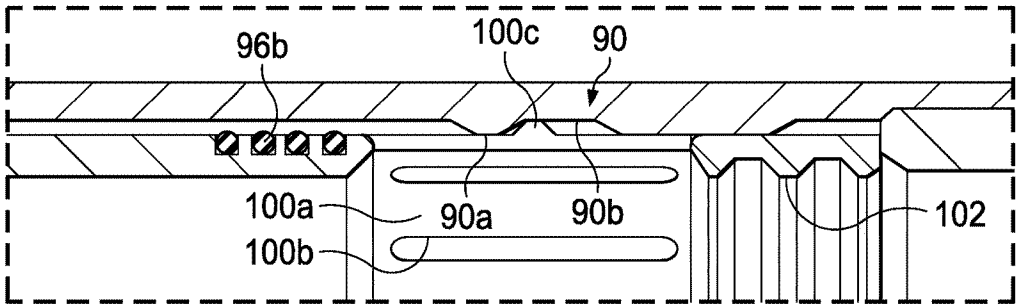
FIG. 5B is an enlarged view of a portion of FIG. 5A, according to an exemplary embodiment.

In an exemplary embodiment, as shown in FIG. 2D and FIG. 4D, the frac sleeve subassembly 72 also defines a portion of the internal flow passage 68 of the lower completion string 50. The frac sleeve subassembly 72 includes several components of the injection sleeve subassembly 70, which components are given the same reference numerals. In several exemplary embodiments, the injection interval 94 of the frac sleeve subassembly 72 may be referred to as a "frac return interval." In several exemplary embodiments, the lengths of several components of the frac sleeve subassembly 72 are substantially less than the respective lengths of the corresponding components of the injection sleeve subassemblies 70. For example, the lengths of the housing 82, the sleeve 84, the injection interval 94, and the sealing interval 98 of the frac sleeve subassembly 72 are substantially less than the lengths of the housing 82, the sleeve 84, the injection interval 94, and the sealing interval 98, respectively, of the injection sleeve subassemblies 70. The remainder of the frac sleeve subassembly 72 is substantially identical to the injection sleeve subassembly 70 and thus will not be described in further detail. The frac sleeve subassembly 72 is shifted between the open configuration and the closed configuration in substantially the same manner as the injection sleeve subassembly 70. However, the selective shifting profile 102 of the frac sleeve subassembly 72 may be different from the selective shifting profile 102 of the injection sleeve subassembly 70. Further, the gravel-pack valve 62 may define yet another profile that is different from the selective shifting profiles 102 of both the injection sleeve subassembly 70 and the frac sleeve subassembly 72. As a result, a shifting tool (not shown) displaced within the lower completion string 50 selectively engages either the selective shifting profile 102 of the frac sleeve subassembly 72, the selective shifting profiles 102 of the injection sleeve subassemblies 70, or the profile of the gravel-pack valve 62 while bypassing the other profiles.

In an exemplary embodiment, as illustrated in FIGS. 2A-2D with reference to FIG. 1, the lower completion string 50 is utilized to stimulate the formation 14. The sump packer 52*d* is set and the casing string 40 is perforated along different zones of the formation 14. The lower completion string 50 is run downhole on a work string (not shown) and service tool (not shown). The service tool includes a shifting tool (not shown) on the lower end portion thereof. The isolation packers 52*a-c* are set, thereby cutting off, or at least limiting, fluid communication between the completion sections 50*a-c* within the annulus 58. Beginning in the lowermost completion section 50*c*, the shifting tool is displaced to shift the frac sleeve subassembly 72 into the full-open configuration, as shown in FIG. 2D, which directs the return flow of the treatment fluid 66 through the frac sleeve subassembly 72 and up the service tool and work string during pumping operations. Alternatively, the frac sleeve subassembly 72 remains in the closed configuration during pumping operations such that the return flow of the treatment fluid 66 through the frac sleeve subassembly 72 is prevented, or at least reduced. The injection sleeve subassemblies 70 remain in the closed configuration during pumping operations, as shown in FIGS. 2B and 2C. The shifting tool is displaced to shift open the gravel-pack valve 62, as shown in FIG. 2A. The service tool is displaced within the lower completion string 50 such that the weight-down collet (not shown) of the service tool rests on the indicator collar 64 of the gravel-pack assembly 54, thereby aligning the crossover port (not shown) of the service tool with the gravel-pack valve 62. The gravel-pack valve 62 directs the flow of the treatment fluid 66 from the crossover port of the service tool into the annulus 58, over the valved filter assembly 56, along the perforated interval, and into the formation 14, thereby stimulating the formation 14 by at least one of: propping open induced fractures in the formation 14 with proppant; and packing gravel over the valved filter assembly 56 to provide a filter which prevents, or at least reduces, the passage of formation fines and sand into the internal flow passage 68 of the lower completion string 50. After the formation 14 is thus stimulated, the shifting tool is displaced to close the gravel-pack valve 62 and, if the frac sleeve subassembly 72 is not already in the closed configuration, to shift the frac sleeve subassembly 72 into the closed configuration, thereby fluidically isolating each of the completion sections 50*a-c* once the section has been completed. The above described process is repeated for completion sections 50*b* and 50*a*, with the work string progressing until each zone of the formation 14 is stimulated.

In an exemplary embodiment, as illustrated in FIGS. 4A-4D with reference to FIG. 1, the well is an injection well. After the formation 14 has been stimulated as described above, the work string (not shown) and service tool (not shown) are removed from the lower completion string 50. An injection tubing string (not shown), having seals and perforated sections, is run downhole from the oil or gas platform 10 into the lower completion string 50. A shifting tool (not shown) is also run into the lower completion string 50 at the bottom of the injection tubing string. The shifting tool is displaced to shift some or all of the injection sleeve subassemblies 70 to the full-open configuration, as shown in FIGS. 4B and 4C, or to the partially-open configuration (not shown). In this manner, the flow of the injection fluid 67 from the internal passage 68 to the annulus 58 can be controlled by opening, closing, or partially-opening selected injection sleeve subassemblies 70 distributed throughout the wellbore 38. The injection tubing string is then displaced within the lower completion string 50 to an injection configuration, wherein the seals of the injection tubing string form a seal at each packer 52 and the perforated sections of the injection tubing string are positioned within the valved filter assemblies 56. In order to achieve injection into the formation 14, the injection fluid 67 flows inside the injection tubing string from the surface, through the perforations in the injection tubing string, and into the internal flow passage 68 of the lower completion string 50. After exiting the final tubing string into the internal flow passage 68, the injection fluid 67 flows through the openings 92 that define the injection intervals 94, into the annular flow passage 78, and through the screen 76, as shown in FIGS. 4B and 4C. The injection fluid 67 exits through the gaps 76*b* in the screen 76 into the gravel-packed annulus 58. The openings 92 and the gaps 76*b* define a direct radial flow path (as opposed to an annular flow path) through the injection interval 94 and the screen 76, which prevents, or at least reduces, the likelihood of clogging inherent to an annular flow path. Finally, the injection fluid 67 is injected into the formation 14 through the perforations in the casing string 40, thereby causing hydrocarbons in the formation 14 to migrate away from the injection well and toward a production well in the same formation 14.

In several exemplary embodiments, the velocity at which the injection fluid 67 passes through the screen 76 varies according to the quantity of openings 92, the size of the openings 92, and/or the length of the injection interval 94. That is, the velocity decreases as the quantity of openings 92, the size of the openings 92, and/or the length of the injection interval 94 increases. The size and quantity of the openings 92 and the length of the injection interval 94 are configured to permit high flow rates during injection of the injection fluid 67 while preventing, or at least reducing, excessive velocities in the annulus 58 as the injection fluid 67 exits the injection interval 94. The prevention or reduction of excessive velocities during injection of the injection fluid 67 prevents, or at least reduces: erosion of the screen 76 adjacent to the injection interval 94; excessive build-up of formation fines in the valved filter assembly 56 due to erosion of the gravel filter packed around the screen 76; and proppant erosion or washout from the induced fractures in the formation 14. In several exemplary embodiments, the injection fluid 67 has a direct radial flow path (as opposed to an annular flow path) from the internal flow passage 68, through the injection interval 94 and the screen 76, and into the annulus 58, thereby preventing, or at least reducing, the likelihood of clogging within an annular flow path.

In an exemplary embodiment, the injection sleeve subassemblies 70 are placed at intervals in each valved filter assembly 56 separated by flush joint pipe 74. In an exemplary embodiment, the amount of total injection flow per valved filter assembly 56 can be adjusted by varying the number of injection sleeve subassemblies 70 per valved filter assembly 56. In an exemplary embodiment, the amount of total injection flow per valved filter assembly 56 can be adjusted by closing one or more of the injection sleeve subassemblies 70 in the valved filter assembly 56. In an exemplary embodiment, the amount of total injection flow per valved filter assembly 56 can be adjusted by varying the size, shape, pattern, and/or distribution of the openings 92 in the housing 82. In another exemplary embodiment, the flush joint pipe 74 is omitted and the injection sleeve subassemblies 70 are connected in series with one another, thereby providing the maximum percent possible of injection intervals 94 per valved filter assembly 56.

In an exemplary embodiment, electric pressure and temperature gauges or fiber optic pressure and temperature gauges are run on the injection tubing string to measure pressure and temperature. In an exemplary embodiment, one or more inflow control devices (ICDs) are run on the injection tubing string to regulate the inflow into each zone of the formation 14. In an exemplary embodiment, a flow regulator is run on the injection tubing string to balance the injection flow into each zone. In an exemplary embodiment, after injection, the injection well is shut-in by shifting the injection sleeve subassemblies 70 to the closed configuration, in order to monitor the pressure drop in the formation 14. During periods of shut-in, the ICDs and the flow regulators can be shut to prevent cross-flow between zones of the formation 14. In an alternate embodiment, the injection tubing string is not run into the lower completion string 50, and zonal isolation is achieved by using, for example, a shifting tool conveyed by conventional wireline, slickline, or coiled tubing to shift the injection sleeve subassemblies 70 to the closed configuration.

Figure 6A:
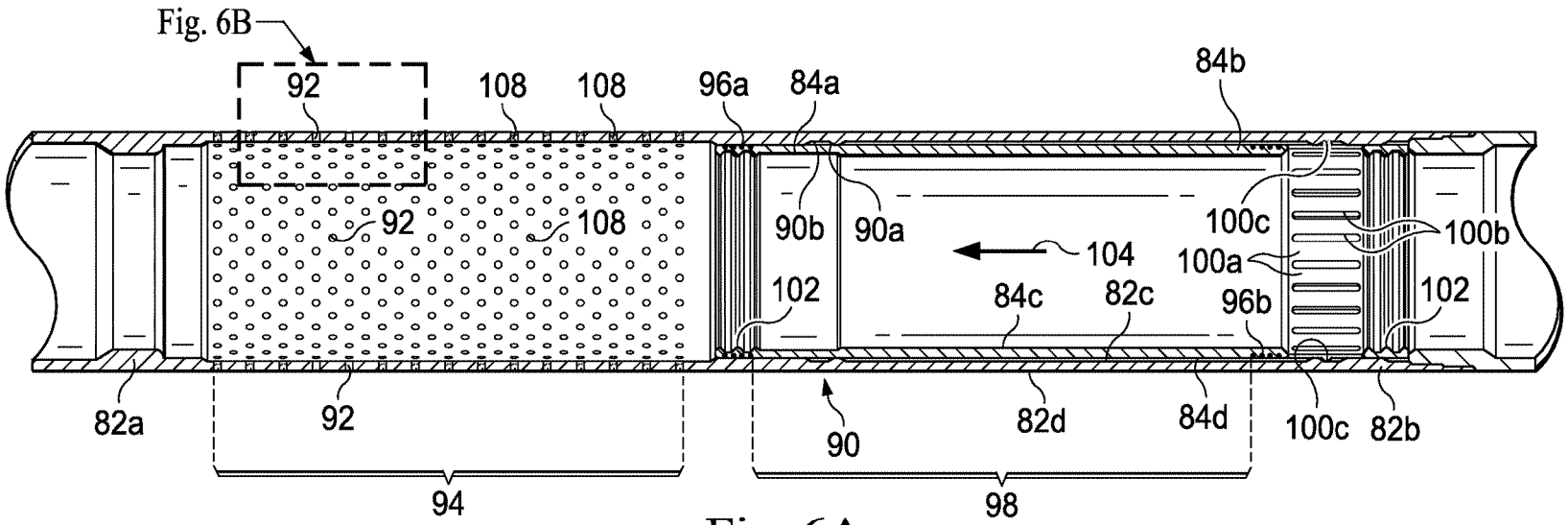
FIG. 6A is a side cross-sectional view of an injection sleeve subassembly that includes degradable plugs, according to an exemplary embodiment.
Figure 6B:
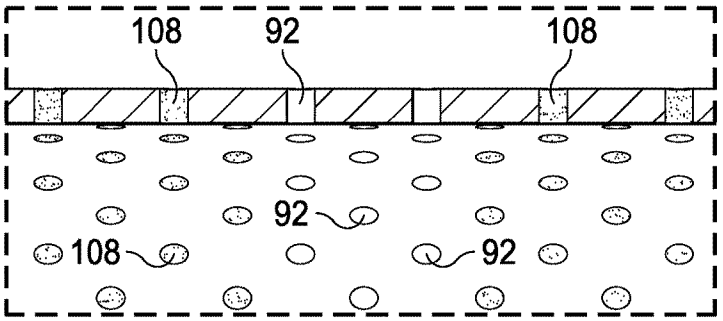
FIG. 6B is an enlarged view of a portion of FIG. 6A, according to an exemplary embodiment.

In an exemplary embodiment, as illustrated in FIGS. 6A and 6B, even after all of the sleeves 84 of the injection sleeve subassemblies 70 are shifted to the partially-open or full-open configuration, the inflow area of the injection sleeve subassemblies 70 may be restricted by another closure member such as, for example, degradable plugs 108. The degradable plugs 108 are installed in a majority of the openings 92 in the housing 82, such that only a few of the openings 92 remain open and the initial inflow area is relatively small, as shown in FIG. 6B. The degradable plugs 108 can later be removed to increase the inflow area through the openings 92 during injection operations. In several exemplary embodiments, the degradable plugs 108 in the housing 82 can be removed with acid, made to degrade with salt water, be eroded out with a nozzle, be removed by some other mechanical or chemical process, or any combination thereof. In several exemplary embodiments, one or more injection sleeve subassemblies 70, each including the sleeve 84, are made-up in the valved filter assembly 56 while one or more others of the injection sleeve subassemblies 70, each including the degradable plugs 108, are also made-up in the valved filter assembly 56. In another exemplary embodiment, the sleeve 84 of the injection sleeve subassembly 70 is omitted and the degradable plugs 108 are added to the housing to prevent, or at least reduce, flow through the openings 92 before injection. The degradable plugs 108 can then be removed to allow flow through the openings 92 during injection operations. In several exemplary embodiments, one or more injection sleeve subassemblies 70, each including the sleeve 84, are made up in the valved filter assembly 56 while one or more others of the injection sleeve subassemblies 70, each omitting the sleeve 84 but including the degradable pugs 108, are also made up in the valved filter assembly 56. In yet another exemplary embodiment, the degradable plugs 108 are used to cover openings (not shown) that are formed in the housing 82 and/or the flush joint pipes 74. The degradable plugs 108 can then be removed to allow flow through the openings (not shown) during injection operations.

The present disclosure introduces an apparatus adapted to extend within a wellbore that traverses a subterranean formation, the apparatus including a tubular housing including opposing first and second end portions and defining an interior surface, an exterior surface, and an internal flow passage; an open inflow area extending radially through the tubular housing and adapted to distribute the radial flow of a fluid from the internal flow passage to the wellbore; a closure member extending within the tubular housing and adapted to cover the open inflow area; and a filter defining a plurality of gaps, the filter concentrically disposed about the exterior surface of the tubular housing and extending axially along at least the open inflow area. In an exemplary embodiment, the open inflow area includes a plurality of openings formed radially through the tubular housing; wherein the plurality of openings define a tubular injection interval extending axially along the tubular housing, the tubular injection interval having a length; and wherein the plurality of opening are either holes or slots. In an exemplary embodiment, the respective sizes of one or more of the openings at the first end portion are less than the respective sizes of one or more of the openings at the second end portion. In an exemplary embodiment, the plurality of openings form a pattern along the length of the tubular housing from the first end portion to the second end portion; wherein the openings are unevenly distributed so that the quantity of openings at the first end portion is less than the quantity of openings at the second end portion. In an exemplary embodiment, a granular media packed around the filter within the wellbore; wherein the fluid is communicated radially from the internal flow passage of the tubular housing to the wellbore at a flow rate, thereby exiting radially into the wellbore at a velocity; and wherein the length of the injection interval combined with the quantity, size, shape, pattern, and/or distribution of the plurality of openings are configured so that the velocity of the fluid exiting the tubular housing into the wellbore is reduced to facilitate reduction of erosion of the filter and to facilitate reduction of washout of the granular media packed around the filter. In an exemplary embodiment, the closure member includes a tubular sleeve including opposing first and second end portions, the tubular sleeve extending within the tubular housing and defining an interior surface and an exterior surface; and first and second seals located at the first and second end portions, respectively, of the tubular sleeve, the first and second seals being disposed radially between the interior surface of the tubular housing and the exterior surface of the tubular sleeve; wherein the first and second seals are separated by an axial distance therebetween, the axial distance being greater than the length of the tubular injection interval. In an exemplary embodiment, the tubular sleeve is moveable within the tubular housing between a closed configuration, a partially open configuration, and a full-open configuration; wherein the closed configuration is achieved by displacing the tubular sleeve to a first position such that the tubular injection interval is located between the first and second seals; wherein the full-open configuration is achieved by displacing the tubular sleeve to a second position such that the first seal is located between the tubular injection interval and the second seal; and wherein the partially-open configuration achieved by displacing the tubular sleeve to a third position between the first position and the second position. In an exemplary embodiment, the closure member includes a plurality of degradable plugs selectively removable from the plurality of openings by a mechanical or chemical process. The present disclosure introduces a well-screen assembly adapted to extend within a wellbore that traverses a subterranean formation, the well-screen assembly including a valved filter assembly including an injection subassembly including a first tubular member defining an internal flow passage, an open inflow area extending radially through the housing and adapted to distribute the radial flow of a fluid from the internal flow passage to the wellbore, a first closure member extending within the first tubular member and adapted to cover the plurality of openings; and a frac-return subassembly connected to the injection subassembly, the frac-return subassembly including a second tubular member, a plurality of ports formed radially through the second tubular member and distributed along a portion thereof, and a second closure member extending within the second tubular member and adapted to selectively cover the plurality of ports; and a filter defining a plurality of gaps, the filter concentrically disposed about at least the first tubular member. In an exemplary embodiment, the open inflow area includes a plurality of openings formed radially through the first tubular member, the plurality of openings defining a tubular injection interval extending axially along the first tubular member, the tubular injection interval having a length. In an exemplary embodiment, the valved filter assembly includes a flush joint pipe made-up between the first and second tubular members, the flush joint pipe providing fluid communication between the injection subasssembly and the frac-return subassembly; and wherein the filter includes a drainage layer adapted to provide fluid communication along the valved filter assembly to the frac-return subassembly. In an exemplary embodiment, a portion of the plurality of openings are formed radially through the flush joint pipe; and wherein the first closure member includes a plurality of degradable plugs selectively removable from the plurality of openings formed in the first tubular member and the flush joint pipe by a mechanical or chemical process. In an exemplary embodiment, a granular media packed around the filter within the wellbore; wherein the fluid is communicated radially from the internal flow passage of the first tubular member to the wellbore at a flow rate, thereby exiting radially into the wellbore at a velocity; and wherein the length of the injection interval combined with the quantity, size, shape, pattern, and/or distribution of the plurality of openings are configured so that the velocity of the fluid exiting the first tubular member into the wellbore is reduced to facilitate reduction of erosion of the filter and to facilitate reduction of washout of the granular media packed around the filter. In an exemplary embodiment, the first closure member includes a tubular sleeve including opposing first and second end portions, the sleeve extending within the housing and defining an interior surface and an exterior surface; and first and second seals located at the first and second end portions, respectively, of the tubular sleeve, the first and second seals being disposed radially between the interior surface of the first tubular member and the exterior surface of the tubular sleeve; wherein the first and second seals are separated by an axial distance therebetween, the axial distance being greater than the length of the tubular injection interval. In an exemplary embodiment, the tubular sleeve is movable within the first tubular member between a closed configuration and a full-open configuration; wherein the closed configuration is achieved by displacing the tubular sleeve to a first position such that the tubular injection interval is located between the first and second seals; and wherein the full-open configuration is achieved by displacing the tubular sleeve to a second position such that the first seal is located between the tubular injection interval and the second seal.

The present disclosure introduces a completion system adapted to be disposed within a wellbore that traverses a subterranean formation, the completion system including a completion section defining an internal flow passage, the completion section including a gravel-pack valve adapted to direct a slurry from the internal flow passage of the completion section to the wellbore when the completion system is disposed within the wellbore; a valved filter assembly defining a lower end portion, the valved filter assembly including an injection valve including a tubular member, a plurality of openings formed radially through the tubular member, the plurality of openings defining a tubular injection interval extending axially along the tubular member, and a closure member extending within the tubular member and adapted to selectively cover the plurality of openings, and a frac-return valve proximate the lower end portion of the valved filter assembly; and a screen defining a plurality of gaps, the screen concentrically disposed about the injection valve; and an isolation packer adapted to seal an annulus defined between the completion section and the wellbore when the completion system is disposed within the wellbore. In an exemplary embodiment, the closure member includes a tubular sleeve defining first and second end portions, the tubular sleeve extending within the tubular member; and first and second seals located at the first and second end portions, respectively, of the tubular sleeve, the first and second seals being disposed radially between the interior surface of the tubular member and the exterior surface of the tubular sleeve; wherein the first and second seals are separated by an axial distance therebetween, the axial distance being greater than the length of the tubular injection interval. In an exemplary embodiment, the tubular sleeve is moveable within the tubular member between a closed configuration, a partially-open configuration, and a full-open configuration; wherein the closed configuration is achieved by displacing the tubular sleeve to a first position such that the tubular injection interval is located between the first and second seals; wherein the full-open configuration is achieved by displacing the tubular sleeve to a second position such that the first seal is located between the tubular injection interval and the second seal; and wherein the partially-open configuration achieved by displacing the tubular sleeve to a third position between the first position and the second position. In an exemplary embodiment, the completion section is adapted to perform a gravel-packing operation; wherein the injection valve is placed in the closed configuration, which prevents communication of the slurry through the plurality of openings in the tubular member, the slurry including a granular media and a carrier fluid; wherein the slurry is communicated into the wellbore through the gravel-pack valve, thereby packing the granular media around the screen within the wellbore; wherein a drainage layer is disposed about the completion section and beneath the screen, the drainage layer being adapted to transfer a portion of the slurry to the frac-return valve; and wherein the frac-return valve communicates a portion of the slurry from the wellbore back to the internal flow passage of the completion section. In an exemplary embodiment, the closure member includes a plurality of degradable plugs selectively removable from the plurality of openings by a mechanical or chemical process.

It is understood that variations may be made in the foregoing without departing from the scope of the disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

Although several exemplary embodiments have been disclosed in detail above, the embodiments disclosed are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. An apparatus adapted to extend within a wellbore that traverses a subterranean formation, the apparatus comprising:

a tubular housing comprising opposing first and second end portions and defining an interior surface, an exterior surface, and an internal flow passage;

an open inflow area extending radially through the tubular housing and adapted to distribute the radial flow of a fluid from the internal flow passage to the wellbore;

a closure member extending within the tubular housing and adapted to cover the open inflow area; and a filter defining a plurality of gaps, the filter concentrically disposed about the exterior surface of the tubular housing and extending axially along at least the open inflow area;

wherein the open inflow area comprises a plurality of openings formed radially through the tubular housing;

wherein the plurality of openings defines a tubular injection interval extending axially along the tubular housing, the tubular injection interval having a length;

wherein the plurality of openings includes holes and/or slots;

wherein the respective sizes of one or more of the openings proximate the first end portion are less than the respective sizes of one or more of the openings proximate the second end portion.

2. An apparatus adapted to extend within a wellbore that traverses a subterranean formation, the apparatus comprising:

a tubular housing comprising opposing first and second end portions and defining an interior surface, an exterior surface, and an internal flow passage;

an open inflow area extending radially through the tubular housing and adapted to distribute the radial flow of a fluid from the internal flow passage to the wellbore;

a closure member extending within the tubular housing and adapted to cover the open inflow area; and a filter defining a plurality of gaps, the filter concentrically disposed about the exterior surface of the tubular housing and extending axially along at least the open inflow area;

wherein the open inflow area comprises a plurality of openings formed radially through the tubular housing;

wherein the plurality of openings defines a tubular injection interval extending axially along the tubular housing, the tubular injection interval having a length;

wherein the plurality of openings includes holes and/or slots;

wherein the plurality of openings forms a pattern along the length of the tubular housing from the first end portion to the second end portion; and wherein the openings are unevenly distributed so that the quantity of openings at the first end portion is less than the quantity of openings at the second end portion.

3. The apparatus of claim 1, further comprising a granular media packed around the filter within the wellbore;

wherein the fluid is communicated radially from the internal flow passage of the tubular housing to the wellbore at a flow rate, thereby exiting radially into the wellbore at a velocity; and wherein the length of the injection interval combined with the quantity, size, shape, pattern, and/or distribution of the plurality of openings are configured so that the velocity of the fluid exiting the tubular housing into the wellbore is reduced to facilitate reduction of erosion of the filter and to facilitate reduction of washout of the granular media packed around the filter.

4. The apparatus of claim 1, wherein the closure member comprises a plurality of degradable plugs selectively removable from the plurality of openings by a mechanical or chemical process.

5. The apparatus of claim 2, further comprising a granular media packed around the filter within the wellbore;

wherein the fluid is communicated radially from the internal flow passage of the tubular housing to the wellbore at a flow rate, thereby exiting radially into the wellbore at a velocity; and wherein the length of the injection interval combined with the quantity, size, shape, pattern, and/or distribution of the plurality of openings are configured so that the velocity of the fluid exiting the tubular housing into the wellbore is reduced to facilitate reduction of erosion of the filter and to facilitate reduction of washout of the granular media packed around the filter.

6. The apparatus of claim 2, wherein the closure member comprises a plurality of degradable plugs selectively removable from the plurality of openings by a mechanical or chemical process.

7. An apparatus adapted to extend within a wellbore that traverses a subterranean formation, the apparatus comprising:

a tubular housing comprising opposing first and second end portions and defining an interior surface, an exterior surface, and an internal flow passage;

an open inflow area extending radially through the tubular housing and adapted to distribute the radial flow of a fluid from the internal flow passage to the wellbore;

a closure member extending within the tubular housing and adapted to cover the open inflow area; and a filter defining a plurality of gaps, the filter concentrically disposed about the exterior surface of the tubular housing and extending axially along at least the open inflow area;

wherein the open inflow area comprises a plurality of openings formed radially through the tubular housing;

wherein the plurality of openings defines a tubular injection interval extending axially along the tubular housing, the tubular injection interval having a length;

wherein the plurality of openings includes holes and/or slots;

wherein the closure member comprises:

a tubular sleeve comprising opposing first and second end portions, the tubular sleeve extending within the tubular housing and defining an interior surface and an exterior surface; and first and second seals located at the first and second end portions, respectively, of the tubular sleeve, the first and second seals being disposed radially between the interior surface of the tubular housing and the exterior surface of the tubular sleeve;

and wherein the first and second seals are separated by an axial distance therebetween, the axial distance being greater than the length of the tubular injection interval.

8. The apparatus of claim 7, wherein the tubular sleeve is moveable within the tubular housing between a closed configuration, a partially open configuration, and a full-open configuration;

wherein the closed configuration is achieved by displacing the tubular sleeve to a first position such that the tubular injection interval is located between the first and second seals;

wherein the full-open configuration is achieved by displacing the tubular sleeve to a second position such that the first seal is located between the tubular injection interval and the second seal; and wherein the partially-open configuration achieved by displacing the tubular sleeve to a third position between the first position and the second position.

9. The apparatus of claim 7, further comprising a granular media packed around the filter within the wellbore;

wherein the fluid is communicated radially from the internal flow passage of the tubular housing to the wellbore at a flow rate, thereby exiting radially into the wellbore at a velocity; and wherein the length of the injection interval combined with the quantity, size, shape, pattern, and/or distribution of the plurality of openings are configured so that the velocity of the fluid exiting the tubular housing into the wellbore is reduced to facilitate reduction of erosion of the filter and to facilitate reduction of washout of the granular media packed around the filter.

10. The apparatus of claim 7, wherein the closure member comprises a plurality of degradable plugs selectively removable from the plurality of openings by a mechanical or chemical process.

11. A well-screen assembly adapted to extend within a wellbore that traverses a subterranean formation, the well-screen assembly comprising:

a valved filter assembly comprising:

an injection subassembly comprising:

a first tubular member defining an internal flow passage;

an open inflow area extending radially through the housing and adapted to distribute the radial flow of a fluid from the internal flow passage to the wellbore;

a first closure member extending within the first tubular member and adapted to cover the open inflow area;

and a frac-return subassembly connected to the injection subassembly, the frac-return subassembly comprising:

a second tubular member;

a plurality of ports formed radially through the second tubular member and distributed along a portion thereof; and a second closure member extending within the second tubular member and adapted to selectively cover the plurality of ports;

and a filter defining a plurality of gaps, the filter concentrically disposed about at least the first tubular member.

12. The well-screen assembly of claim 11, wherein the open inflow area comprises a plurality of openings formed radially through the first tubular member, the plurality of openings defining a tubular injection interval extending axially along the first tubular member, the tubular injection interval having a length.

13. The well-screen assembly of claim 12, wherein the valved filter assembly comprises a flush joint pipe made-up between the first and second tubular members, the flush joint pipe providing fluid communication between the injection subassembly and the frac-return subassembly; and wherein the filter comprises a drainage layer adapted to provide fluid communication along the valved filter assembly to the frac-return subassembly.

14. The well-screen assembly of claim 13, wherein a portion of the plurality of openings are formed radially through the flush joint pipe; and wherein the first closure member comprises a plurality of degradable plugs selectively removable from the plurality of openings formed in the first tubular member and the flush joint pipe by a mechanical or chemical process.

15. The well-screen assembly of claim 12, further comprising a granular media packed around the filter within the wellbore;

wherein the fluid is communicated radially from the internal flow passage of the first tubular member to the wellbore at a flow rate, thereby exiting radially into the wellbore at a velocity; and wherein the length of the injection interval combined with the quantity, size, shape, pattern, and/or distribution of the plurality of openings are configured so that the velocity of the fluid exiting the first tubular member into the wellbore is reduced to facilitate reduction of erosion of the filter and to facilitate reduction of washout of the granular media packed around the filter.

16. The well-screen assembly of claim 12, wherein the first closure member comprises:

a tubular sleeve comprising opposing first and second end portions, the sleeve extending within the housing and defining an interior surface and an exterior surface; and first and second seals located at the first and second end portions, respectively, of the tubular sleeve, the first and second seals being disposed radially between the interior surface of the first tubular member and the exterior surface of the tubular sleeve;

wherein the first and second seals are separated by an axial distance therebetween, the axial distance being greater than the length of the tubular injection interval.

17. The well-screen assembly of claim 16, wherein the tubular sleeve is movable within the first tubular member between a closed configuration and a full-open configuration;

wherein the closed configuration is achieved by displacing the tubular sleeve to a first position such that the tubular injection interval is located between the first and second seals; and wherein the full-open configuration is achieved by displacing the tubular sleeve to a second position such that the first seal is located between the tubular injection interval and the second seal.

18. A completion system adapted to be disposed within a wellbore that traverses a subterranean formation, the completion system comprising:

a completion section defining an internal flow passage, the completion section comprising:

a gravel-pack valve adapted to direct a slurry from the internal flow passage of the completion section to the wellbore when the completion system is disposed within the wellbore;

a valved filter assembly defining a lower end portion, the valved filter assembly comprising:

an injection valve comprising:

a tubular member;

a plurality of openings formed radially through the tubular member, the plurality of openings defining a tubular injection interval extending axially along the tubular member; and a closure member extending within the tubular member and adapted to selectively cover the plurality of openings;

and a frac-return valve proximate the lower end portion of the valved filter assembly;

and a screen defining a plurality of gaps, the screen concentrically disposed about the injection valve;

and an isolation packer adapted to seal an annulus defined between the completion section and the wellbore when the completion system is disposed within the wellbore.

19. The completion system of claim 18, wherein the closure member comprises:

a tubular sleeve defining first and second end portions, the tubular sleeve extending within the tubular member; and first and second seals located at the first and second end portions, respectively, of the tubular sleeve, the first and second seals being disposed radially between the interior surface of the tubular member and the exterior surface of the tubular sleeve;

wherein the first and second seals are separated by an axial distance therebetween, the axial distance being greater than the length of the tubular injection interval.

20. The completion system of claim 19, wherein the tubular sleeve is moveable within the tubular member between a closed configuration, a partially-open configuration, and a full-open configuration;

wherein the closed configuration is achieved by displacing the tubular sleeve to a first position such that the tubular injection interval is located between the first and second seals;

wherein the full-open configuration is achieved by displacing the tubular sleeve to a second position such that the first seal is located between the tubular injection interval and the second seal; and wherein the partially-open configuration achieved by displacing the tubular sleeve to a third position between the first position and the second position.

21. The completion system of claim 20, wherein the completion section is adapted to perform a gravel-packing operation;

wherein the injection valve is placed in the closed configuration, which prevents communication of the slurry through the plurality of openings in the tubular member, the slurry comprising a granular media and a carrier fluid;

wherein the slurry is communicated into the wellbore through the gravel-pack valve, thereby packing the granular media around the screen within the wellbore;

wherein a drainage layer is disposed about the completion section and beneath the screen, the drainage layer being adapted to transfer a portion of the slurry to the frac-return valve; and wherein the frac-return valve communicates a portion of the slurry from the wellbore back to the internal flow passage of the completion section.

22. The completion system of claim 18, wherein the closure member comprises a plurality of degradable plugs selectively removable from the plurality of openings by a mechanical or chemical process.

* * * * *